US011208764B2

(12) United States Patent
Eberhardt et al.

(10) Patent No.: US 11,208,764 B2
(45) Date of Patent: Dec. 28, 2021

(54) PAPER MACHINE CLOTHING, METHOD FOR PRODUCING SAME, AND NONWOVEN FABRIC

(71) Applicant: VOITH PATENT GMBH, Heidenheim (DE)

(72) Inventors: Robert Eberhardt, Ellwangen (DE); Susanne Klaschka, Cologne (DE); Hubert Walkenhaus, Kerpen (DE)

(73) Assignee: Voith Patent GmbH, Heidenheim (DE)

( * ) Notice: Subject to any disclaimer, the term of this patent is extended or adjusted under 35 U.S.C. 154(b) by 0 days.

(21) Appl. No.: 16/648,302

(22) PCT Filed: Sep. 13, 2018

(86) PCT No.: PCT/EP2018/074707
§ 371 (c)(1),
(2) Date: Mar. 18, 2020

(87) PCT Pub. No.: WO2019/063302
PCT Pub. Date: Apr. 4, 2019

(65) Prior Publication Data

US 2020/0270811 A1 Aug. 27, 2020

(30) Foreign Application Priority Data

Sep. 29, 2017 (DE) ..... 102017122668

(51) Int. Cl.
*D21F 7/08* (2006.01)
*D21F 7/10* (2006.01)

(52) U.S. Cl.
CPC ..... *D21F 7/083* (2013.01); *D21F 7/10* (2013.01)

(58) Field of Classification Search
CPC ..... D21F 7/083; D21F 7/10; D21F 7/08
See application file for complete search history.

(56) References Cited

U.S. PATENT DOCUMENTS

2006/0278361 A1* 12/2006 Westerkamp ..... D21F 1/0036 162/348
2009/0211722 A1 8/2009 Crook et al.
2010/0263820 A1 10/2010 Koekritz et al.

FOREIGN PATENT DOCUMENTS

CN 101978111 A 2/2011
DE 102005023390 A1 11/2006
(Continued)

*Primary Examiner* — Eric Hug
*Assistant Examiner* — Matthew M Eslami
(74) *Attorney, Agent, or Firm* — Laurence A. Greenberg; Werner H. Stemer; Ralph E. Locher

(57) ABSTRACT

A clothing for a machine for producing a fibrous web, especially a paper, cardboard, tissue or cellulose pulp web. The clothing has a basic structure with a top side and a running side as well as a nonwoven support at least on one side. The nonwoven support has a functional zone, which extends over more than 50 μm in the thickness direction of the clothing and which includes a first portion and a second portion of nonwoven fibers. The nonwoven fibers of the first portion are formed of, or include, a polyurethane, especially a thermoplastic polyurethane, while the nonwoven fibers of the second portion are a polymer material not including a polyurethane. The first portion makes up between 10 wt. % and 60 wt. %, of the functional zone. There is also described a method for production and a suitable nonwoven fabric.

19 Claims, 3 Drawing Sheets

(56) References Cited

FOREIGN PATENT DOCUMENTS

| | | | | | |
|---|---|---|---|---|---|
| DE | 102007000578 | A1 * | 4/2009 | ..... | D21F 7/083 |
| DE | 102007000578 | A1 | 4/2009 | | |
| DE | 102009002433 | A1 | 10/2010 | | |
| WO | 2016071262 | A1 | 5/2016 | | |
| WO | WO-2016071262 | A1 * | 5/2016 | ..... | D21F 7/083 |

* cited by examiner

PAPER MACHINE CLOTHING, METHOD FOR PRODUCING SAME, AND NONWOVEN FABRIC

BACKGROUND OF THE INVENTION

Field of the Invention

The invention relates to a machine clothing as for a machine for producing a fibrous web, especially a paper, cardboard, tissue or cellulose pulp web, comprising a basic structure having a top side and a running side as well as a nonwoven support at least on one side. The nonwoven support has a functional zone, which extends over more than 50 μm in the thickness direction of the paper machine clothing and which comprises a first portion and a second portion of nonwoven fibers. The nonwoven fibers of the first portion consist of a polyurethane, especially a thermoplastic polyurethane, or comprise such, while the nonwoven fibers of the second portion consist of a polymer material not comprising a polyurethane. The invention also relates to a method for producing a paper machine clothing and a nonwoven fabric for use as a nonwoven layer in a paper machine clothing.

During the manufacture of fibrous webs, especially paper, tissue, cardboard or cellulose pulp webs, various technical textiles are used in the form of paper machine clothings. These paper machine clothings fulfill a number of tasks, such as transport of the fibrous web, dewatering or structurizing of the web, to mention only a few.

Within the pressing section, press felts are generally used. These felts customarily comprise a woven basic structure and one or more layers of nonwoven fibers. The materials used and the construction or arrangement of the individual layers are optimized for the intended use.

The fibers of the nonwoven layers are polymer fibers. Customarily, a polyamide (PA) such as a PA 6 or PA 6.6 is used For some time there have been attempts to improve the properties of a press felt by the use of other materials in the nonwoven fabric layers or to adapt the properties better and more easily to customer specific requirements.

In DE 10 2005 023 390 the use of ultrathin nonwoven layers is described, whose fibers can consist of a plurality of polymer materials, in particular polyurethanes.

In DE 10 2007 000 578 A1 felts are described in which a nonwoven layer consists entirely or mostly of fibers consisting of a thermoplastic polyurethane.

The advantage of such nonwoven layers had already been recognized for several years in the prior art. However, in the succeeding 10 years, success was not achieved in the reliable production of such felts. This was due, among other things, to the availability of suitable fibers of polyurethane, as well as unforeseen difficulties in the processing of the fibers.

One problem which the invention proposes to solve is to indicate a paper machine clothing as well as a method for its production which brings to bear the positive properties of polyurethane fibers, yet is simple and reliable to produce.

Another problem which the invention proposes to solve is to indicate a paper machine clothing as well as a method for its production which can be produced on existing equipment which is designed for the processing of PA fibers.

Another problem which the invention proposes to solve is to indicate a paper machine clothing as well as a method for its production which achieves its operational properties at once or after only a brief run-in period after being installed as a paper machine clothing of a paper machine.

Another problem which the invention proposes to solve is to indicate a paper machine clothing as well as a method for its production which reduces the remoistening of the fibrous web when used as paper machine clothing in a paper machine.

SUMMARY OF THE INVENTION

The problems are solved entirely by a paper machine clothing as claimed, by a method for production of a paper machine clothing as claimed, and by a nonwoven fabric as claimed.

Regarding the paper machine clothing, the problem is solved by a paper machine clothing for a machine for producing a fibrous web, especially a paper, cardboard, tissue or cellulose pulp web. The paper machine clothing comprises a basic structure having a top side and a running side as well as a nonwoven support at least on one side. This nonwoven support has a functional zone, which extends over more than 50 μm in the thickness direction of the paper machine clothing and which comprises a first portion and a second portion of nonwoven fibers, wherein the nonwoven fibers of the first portion consist of a polyurethane (PU), especially a thermoplastic polyurethane (TPU), or comprise such, while the nonwoven fibers of the second portion consist of a polymer material not comprising a polyurethane.

According to the invention, it is provided that the first portion makes up between 10 wt. % and 60 wt. %, preferably between 15 wt. % and 50 wt. %, especially preferably between 20 wt. % and 45 wt. % of the functional zone.

In the following, nonwoven fibers of the first portion which consist of or comprise a polyurethane shall be called PU fibers.

Nonwoven fibers which consist of or comprise a thermoplastic polyurethane shall be called TPU fibers. TPU fibers are also PU fibers as well.

The apportionment according to the invention between nonwoven fibers of polyurethane (PU)—an elastomer—and other polymer fibers represents to a certain extent an optimal compromise. The PU fibers as such are very difficult to process. Thus, for example, a carding of the fibers in a teasel is next to impossible. Nonwoven fibers of other polymer materials can be processed much more easily here.

A functional zone of the indicated kind can be created, for example, by needling a nonwoven layer of a blend of PU fibers and fibers of other polymers, such as a polyamide, to the basic structure and possibly further nonwoven layers.

Due to the needling, nonwoven fibers of neighboring nonwoven layers might become blended. But if no nonwoven layer used has more than 60% (50%, 48%, etc.) of PU fibers, it is ensured that the functional zone in the felt also has not more than 60% (50%, 48%, etc.) of PU fibers.

Experiments of the applicant have revealed that the processability, in particular the cardability, of the PU nonwoven fibers is massively improved when they are blended with a portion of nonwoven fibers made of other polymers.

Already with a portion of 40 wt. % of non-PU fibers or 60 wt. % of PU fibers in the nonwoven layer, a processing on existing teasels is possible with no problem. With even smaller portions of PU fibers, such as 50 wt. % or less, hardly any difference is noticeable any more compared to classical nonwoven fabrics in regard to cardability.

The portion of PU fibers, in particular TPU fibers, in the nonwoven layer brings about a faster start-up of the paper machine clothing. While press felts today usually require several days before they have been run in, that is, before they reach their definitive properties, paper machine clothing according to the invention can achieve this after only a few hours.

Hence, a paper machine can reach its maximum production speed more quickly. This can sometimes be achieved within a few hours with felts according to one aspect of the invention.

Furthermore, experiments have shown that, thanks to using a nonwoven support with a functional zone having a portion of PU fibers according to the invention for a press felt, the remoistening of the fibrous web after leaving the press nip is significantly reduced.

Advantageous embodiments of the paper machine clothing are specified in the dependent claims.

The effect of the PU fibers on the start-up behavior as well as the remoistening can also be adjusted through the thickness of the functional zone.

When special basic structures are used, such as multilayered structures, in particular laminated structures, a compacting of the basic structure may occur during the startup, yet this is pronounced to a different degree from one structure to another.

Especially in basic structures with rather intense compacting during start-up, a greater thickness of the functional zone may be advantageous. In particular, it is provided that the functional zone extends for more than 100 μm, especially for 200 μm, 300 μm, 500 μm or more.

When the thickness of the functional zone is significantly larger than the compacting of the basic structure, the additional benefit of a further increasing of the thickness of the functional zone often diminishes. In preferred embodiments, the functional zone may thus have a thickness of less than 5 mm, in particular less than 3 mm.

In many paper machine clothings, a range between 250 μm and 1.5 mm has proven to be favorable.

Advantageously, a nonwoven support is provided on the top side and/or the bottom side of the basic structure.

It may be provided in preferred embodiments that the nonwoven support of the top side and/or the bottom side has at least one functional zone.

A functional zone may be positioned however desired inside the nonwoven support.

In advantageous embodiments, a functional zone may be arranged inside a nonwoven support of the top side such that neither the surface touching the fibrous web is available, nor does it border directly on the basic structure. Yet this need not be the case. It is entirely possible for the functional zone to provide the surface touching the fibrous web and/or to be arranged in direct contact with the basic structure.

In further advantageous embodiments, a functional zone may be arranged inside a nonwoven support of the bottom side so that neither the surface touching the machine elements is made available, nor does it border directly on the basic structure. Yet this need not be the case. It is entirely possible for the functional zone to provide the surface touching the machine elements and/or to be arranged in direct contact with the basic structure.

It may often be advantageous for the portion of PU fibers or TPU fibers in the functional zone to be not too low. A portion between 10 wt. % and 60 wt. %, preferably between 20 wt. % and 50 wt. %, especially preferably between 25 wt. % and 48 wt. %, has proven to be an especially advantageous range in which an optimum between good processability due to a reduced PU fiber portion and the positive properties of the PU fibers, such as rapid start-up and reduced remoistening [is achieved].

In advantageous embodiments, the nonwoven fibers of the second portion may consist entirely or partly of a polyamide, such as a PA 6 or PA 6.6, or may comprise such. These are conventional nonwoven fibers which can be blended and processed together with the PU fibers especially well.

Furthermore, it may be advantageously provided that the nonwoven fibers of the first portion, i.e., the PU fibers or TPU fibers, have fiber fineness between 30 dtex and 80 dtex, especially between 50 dtex and 70 dtex. In particular, nonwoven fibers with 22 dtex, 44 dtex or 67 dtex may be advantageous.

It may be provided that all PU fibers have the same fiber fineness. Alternatively, however, it may also be provided that the PU fibers of the first portion have different fiber fineness. In particular, it may be advantageous when the PU fibers of the first portion have two or three In another advantageous embodiment, it may be provided that the nonwoven fibers of the second portion have fiber fineness between 10 dtex and 80 dtex, especially between 20 dtex and 70 dtex. Also for the second portion, nonwoven fibers with 22 dtex, 44 dtex or 67 dtex may be advantageous.

Furthermore, it may be advantageous when the PU fibers all have the same fiber fineness or different fiber fineness.

Furthermore, it may be advantageous when the non-PU fibers of the second portion all have the same fiber fineness or different fiber fineness.

Furthermore, it may also be advantageous when the PU fibers of the first portion have the same fiber fineness as the fibers of the second portion.

Alternatively, it may also be advantageous when the PU fibers of the first portion have different fiber fineness than the fibers of the second portion.

A very advantageous example of this may be that the first portion comprises nonwoven fibers of a given fiber fineness, while the second portion comprises nonwoven fibers with two or more fiber finenesses.

Alternatively, it may also be provided that the second portion comprises nonwoven fibers of a given fiber fineness, while the first portion comprises nonwoven fibers with two or more fiber finenesses.

The processability of the nonwoven can be improved by a combination of different fiber finenesses.

In another advantageous embodiment, it may be provided that the PU fibers are all made from the same polyurethane or from different polyurethanes.

Furthermore, it may be advantageous when the non-PU fibers of the second portion are all made from the same polymer or from different polymers.

In another very advantageous embodiment, it may be provided that at least some, in particular all of the PU fibers or the PU material used for the first portion have a hardness of 35 Shore D, 40 Shore D or more, in particular 50 Shore D or more.

If the hardness of the PU fibers is too high, it may be that the benefits of the invention will be less pronounced. It may therefore be advantageous when at least some, in particular all of the PU fibers or the PU material used for the first portion have a hardness of 85 Shore D or less, especially 80 Shore D or less.

In especially advantageous embodiments, a PU material or PU materials may thus be used for some, in particular for all PU fibers, that lie in a preferred hardness range between 35 Shore D and 85 Shore D. An especially preferred hardness range is between 40 Shore D and 80 Shore D.

The Shore hardness is a material parameter for elastomers and synthetic materials and it is set forth in the standards DIN EN ISO 868 and DIN ISO 7619-1.

Advantageously it may be provided that between 15 g/m$^2$ and 250 g/m$^2$, in particular between 70 and 180 g/m$^2$ of nonwoven fibers of the first portion (PU fibers, especially TPU fibers) are provided in the nonwoven support of one side.

In another preferred embodiment, it may be provided that between 100 g/m$^2$ and 1500 g/m$^2$, in particular between 600 g/m$^2$ and 1000 g/m$^2$ of nonwoven fibers of the second portion are provided in the nonwoven support of one side.

It may be advantageously provided that the functional zone makes up the entire thickness of a nonwoven support.

In another advantageous embodiment, it may be provided that the functional zone makes up only part of the thickness of a nonwoven support.

In especially advantageous embodiments, it may be further provided that at least one further zone is provided, in which the portion of PU fibers amounts to less than 10 wt. %, and this further zone is arranged between the basic structure and the functional zone and/or between the functional zone and the surface of the paper machine clothing.

Often at least two further zones are provided. For example, a further zone may first be provided on the top side of the basic structure, in which the portion of the PU fibers is less than 10%, followed by a functional zone with a portion between 10% and 60% of PU fibers, and a second further zone with less than 10% PU fibers. This second zone also constitutes the surface of the paper machine clothing touching the fibrous web in this example.

In another advantageous application, it may be provided that the functional zone represents the surface of the paper machine clothing touching the fibrous web.

In further advantageous embodiments, multiple functional zones may also be provided. In particular, multiple functional zones may be provided on one side of the basic structure.

It is especially advantageous when the paper machine clothing is a press felt. In particular, the felt may be a seamed felt.

Advantageously, it may be provided that the basic structure consists of or comprises a circular weave basic structure.

Alternatively, it may also be provided that the basic structure comprises or consists of a flat weave. In particular, a basic structure may also comprise multiple fabric layers, as well as combinations of circular weave and flat weave structures.

It may also be provided that the basic structure comprises a flat weave which is narrower than the later basic structure or paper machine clothing. The desired width may then be achieved, for example, by coiling.

The basic structures are not limited to woven basic structures. It may also be provided that the basic structure comprises a scrim, or consists of such. Such scrims may be constructed, for example, by coiling of one or more threads.

It is also possible to combine woven and nonwoven elements in a basic structure

Regarding the nonwoven fabric, the problem is solved by a nonwoven fabric for use in a paper machine clothing for a machine for producing a fibrous web, which comprises a first portion and a second portion of nonwoven fibers, wherein the nonwoven fibers of the first portion consist of a polyurethane, especially a thermoplastic polyurethane, or comprise such, and the nonwoven fibers of the second portion consist of a polymer material not comprising a polyurethane. According to the invention, it is provided that this first portion makes up between 10 wt. % and 60 wt. %, preferably between 10 wt. % and 50 wt. %, especially preferably between 20 wt. % and 45 wt. % of the nonwoven fabric.

In particular, it may be provided that the nonwoven fibers of the second portion consist of a polyamide, such as a PA 6 or PA 6.6.

Such nonwoven fabrics are very advantageous in their handling and can also be easily produced and processed on existing machines, which are generally designed for PA nonwoven fibers.

For the determination of the wt. % of the first and second portion, a number of methods are possible for the person skilled in the art. Thus, for example, in the case of a blend consisting of PU fibers and polyamide fibers, the portion of the PA fibers can be dissolved by means of formic acid. The PU fibers will remain intact. By weighing the sample before and after, the portion of the PU fibers and the PA fibers can be easily determined.

Regarding the method, the problem is solved by a method for producing a paper machine clothing, involving the following process steps:

i) providing of a basic structure
ii) providing of a functional nonwoven layer, consisting of a nonwoven fabric according to the invention
iii) securing of the functional nonwoven layer, as well as possible further nonwoven layers, to the basic structure by needling.

In advantageous embodiments, moreover, even further nonwoven layers may be needled to the basic structure. In particular, these may be nonwoven layers not comprising any PU fibers. However, they may also be further functional nonwoven layers again consisting of a nonwoven fabric of PU fibers and non-PU fibers according to the invention.

BRIEF DESCRIPTION OF THE SEVERAL VIEWS OF THE DRAWING

In the following, the invention shall be explained more closely with the aid of schematic figures, not drawn to scale.

DETAILED DESCRIPTION OF THE INVENTION

Figure 1:
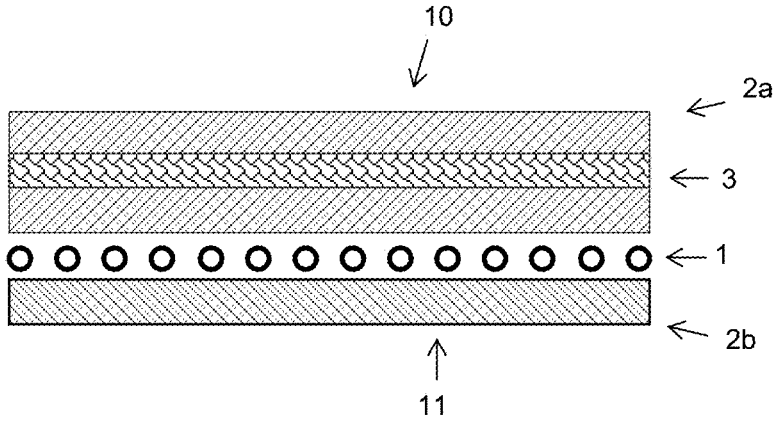
FIG. 1 to FIG. 4 respectively show a paper machine clothing according to one aspect of the invention.

FIG. 1 shows schematically a first section through a paper machine clothing according to one aspect of the invention. It comprises a basic structure 1, being in this embodiment a woven basic structure 1. The weave may be a single or a multiple ply. In general, a woven basic structure 1 may consist of a single weave or also multiple weaves, or comprise such. On the bottom side of the basic structure 1 there is provided a nonwoven support 2*b*. This may be a traditional nonwoven support with nonwoven fibers made from a polyamide. This nonwoven support 2*b* also provides the running side 11 of the paper machine clothing.

On the top side of the basic structure 1 there is provided a further nonwoven support 2*a*. This nonwoven support 2*a* comprises a functional zone 3. The thickness of the functional zone 3 is at least 100 μm, preferably more than 200 μm or more than 300 μm. This functional zone 3 comprises a first portion of PU fibers as well as a second portion of non-PU fibers. The first portion makes up between 10 wt. % and 60 wt. %, preferably between 10 wt. % and 50 wt. %, especially preferably between 20 wt. % and 45 wt. % of the functional zone.

The top nonwoven support 2*a* may comprise basically all kinds of nonwoven fibers outside of the functional zone. Advantageously, for example, it may consist primarily of non-PU fibers. The portion of the PU fibers outside the functional zone can make up 10 wt. % or less, for example.

The top nonwoven support 2*a* also provides the surface 10 touching the fibrous web.

The functional zone 3 in the embodiment of FIG. 1 is arranged such that it neither provides the surface 10 touching the fibrous web nor borders directly on the basic structure. Yet this need not be the case. It is entirely possible for the functional zone 3 to provide the surface 10 touching the fibrous web and/or to be arranged in direct contact with the basic structure.

Figure 2:
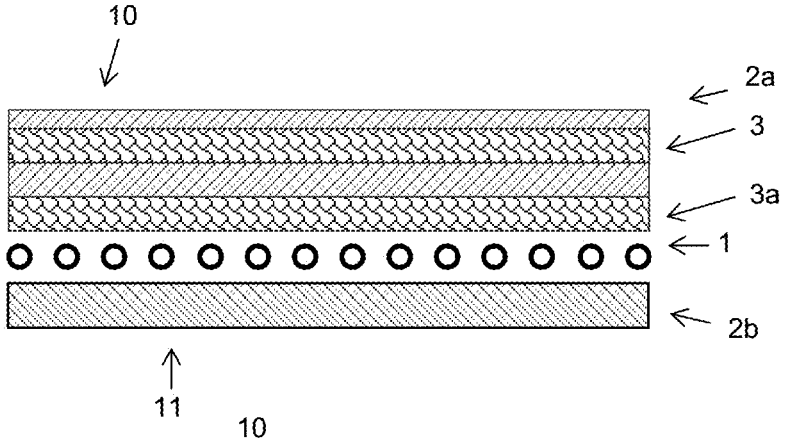

The paper machine clothing represented in FIG. 2 differs from that represented in FIG. 1 basically in that the top nonwoven support 2*a* has two functional zones 3, 3*a*, having respectively PU fibers and non-PU fibers. In both functional zones, the portion of the PU fibers is between 10 wt. % and 60 wt. %, preferably between 10 wt. % and 50 wt. %, –%, especially preferably between 20 wt. % and 45 wt. %. It may be provided that the portion of PU fibers in the different functional zones 3, 3*a* is the same or different. Furthermore, it may be provided that the material of the nonwoven fibers and/or the fiber fineness in the different functional zones 3, 3*a* is the same or different.

Between the two functional zones 3, 3*a* there is provided a region in which the portion of the PU fibers is less than 10 wt. %.

One functional zone 3*a* of the paper machine clothing shown in FIG. 2 borders directly on the basic structure 1. In other embodiments, however, multiple functional zones 3, 3*a* may also be provided, none of which borders directly on the basic structure 1.

Figure 3:
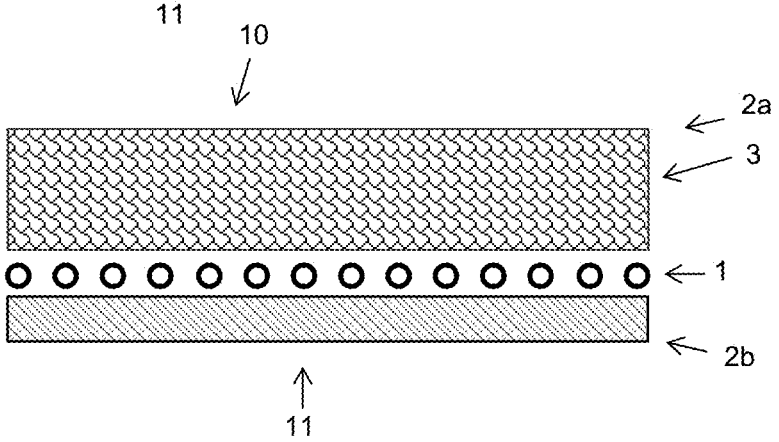

The paper machine clothing shown in FIG. 3 has, in contrast with FIG. 1 and FIG. 2, a nonwoven support 2*a* on the top side consisting entirely of a functional zone. The portion of the PU fibers here is between 10 wt. % and 60 wt. %, preferably between 10 wt. % and 50 wt. %, especially preferably between 20 wt. % and 45 wt. % of the top nonwoven support 2*a*. Yet it may also be provided that the nature of the nonwoven fibers, in particular the PU fibers, may vary across the thickness of the nonwoven support 2*a*.

Figure 4:
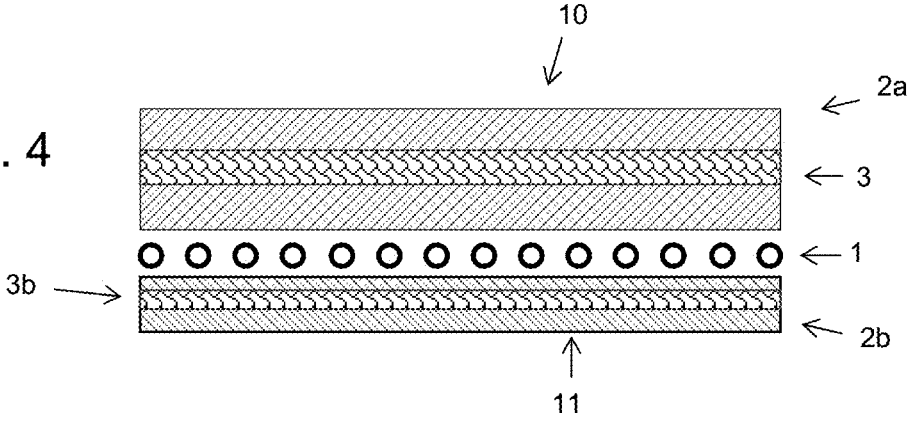

FIG. 4 shows a paper machine clothing which differs from that shown in FIG. 1 in that a further functional zone 3*b* is provided in the bottom nonwoven support 2*b*. Such a functional zone 3*b* in the bottom nonwoven support 2*b* may be provided regardless of the configuration of the top nonwoven support, i.e., also for paper machine clothings of the kind shown in FIG. 2 or 3, for example. Once again, the functional zone 3*b* may be positioned howsoever desired within the bottom nonwoven support, i.e., also in direct contact with the basic structure 1, or such that it provides the running side 11 of the paper machine clothing.

Figure 5A:
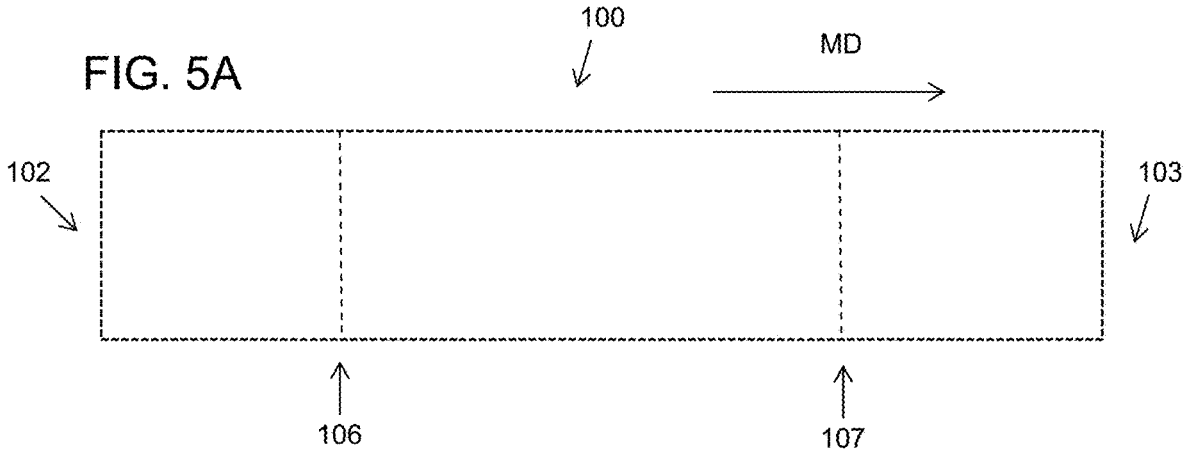
FIGS. 5*a* to 5*c* show a class of basic structures which can be used advantageously for the present invention.
Figure 5B:
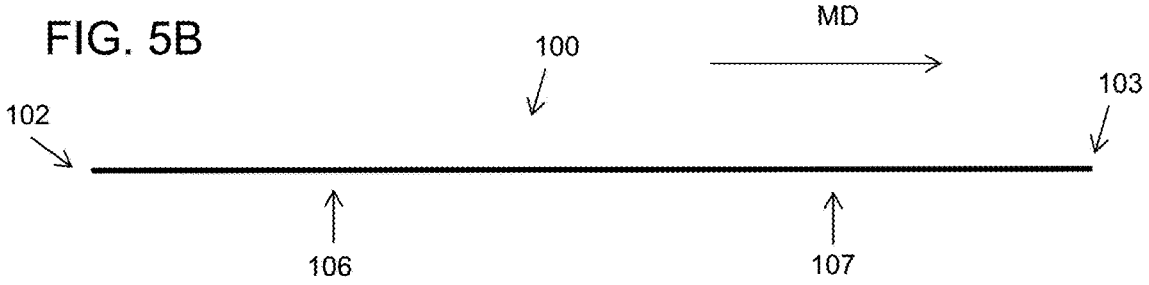
Figure 5C:
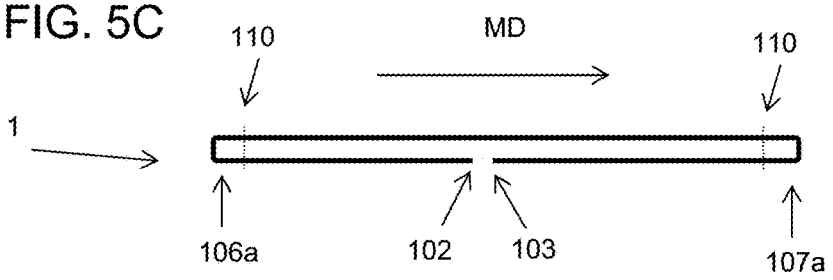

FIGS. 5*a* to 5*c* show a basic structure 1 which is especially advantageous for a paper machine clothing according to the present invention.

A weave 100, in particular a flat woven weave 100, is used for the basic structure 1, having substantially twice the length of the finished paper machine clothing. This weave 100 has end-side edges 102, 103. In order to produce the basic structure 1, the weave 100 is folded at folding points 106, 107, and the folded parts are placed in turn on the weave 100. This produces a shape having two layers as compared to the original weave 100. The end-side edges 102, 103 may overlap, touch, or as shown in FIG. 5*c* have a slight spacing from each other. For better handling, the end-side edges 102, 103 may also be joined together in suitable manner. Furthermore, it may also be provided that the two layers are joined together. This may be done, for example, by seam joints 110. Seam loops 106*a*, 107*a* can be formed from the folding points 106, 107, which is preferably done by removing weave threads in the machine cross direction (CD). These seam loops 106*a*, 107*a* can be joined together and merged into an endless structure in a way familiar to the skilled person by means of a pintle. Now, nonwoven supports 2*a*, 2*b* can be placed on such a basic structure 1 and be secured by needling.

Figure 5D:
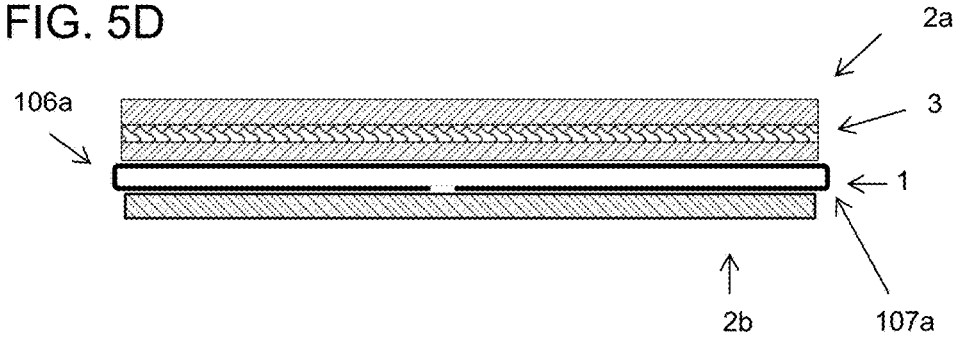
FIG. 5*d* shows a paper machine clothing according to another aspect of the invention making use of a basic structure from FIGS. 5*a* to 5*c*

FIG. 5*d* shows as an example a basic structure 1, as shown in FIGS. 5*a* to 5*c*, which uses as the basic structure 1 a paper machine clothing as shown in FIG. 1.

Figure 6:
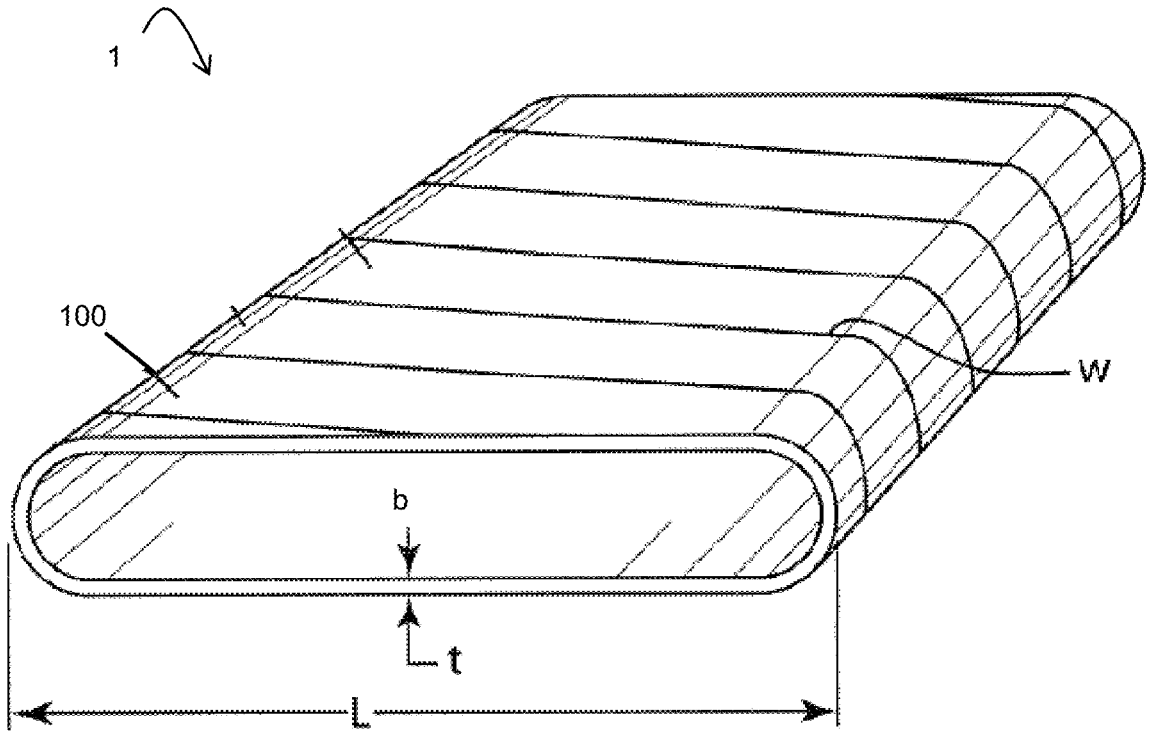
FIG. 6 shows another possible basic structure for a paper machine clothing according to another aspect of the invention.

FIG. 6 shows another possible basic structure 1. The basic structure 1 here is formed from a flat weave 100, which is narrower than the later basic structure 1 or the paper machine clothing. The required width of the basic structure 1 was realized by coiling the flat weave 100. In frequent embodiments, the flat weave 100 has a width between 50 cm and 2 m, in particular 100 cm. The length L of the resulting loop is generally over 10 m, also often over 20 m or 30 m. At the abutment joints W, the edges of the weave 100 of adjacent coils can be joined together, in particular they can also be welded together.

A loop as is shown in FIG. 6 can be used directly as the basic structure 1 for an endless paper machine clothing. The top side t and/or the bottom side b may be further provided with nonwoven supports.

Alternatively, however, this basic structure may also serve as a basic structure 1 for a seamed felt. In this case, the loop 1 is produced similarly to FIGS. 5*c* and 5*d* basically in twice the length of the paper machine clothing, and laid on top of one another to form a flat, double-layered shape. This once again produces folds, which serve as the basis of the seam loops of the seam joint as described above. Now, once again nonwoven supports 2*a*, 2*b* can be placed on such a basic structure 1 and be secured by needling, for example.

The examples shown constitute advantageous embodiments of the invention. However, the invention is not limited to these embodiments.

The invention claimed is:

1. A clothing for a machine for producing a fibrous web, the clothing comprising:

a basic structure having a top side, a running side, and a nonwoven support at least on one side;

said nonwoven support having a layer being a functional zone that extends over more than 50 μm in a thickness direction of the clothing and includes a first portion and a second portion of nonwoven fibers;

said nonwoven fibers of said first portion containing a polyurethane, and said nonwoven fibers of said second portion consisting of a polymer material not including a polyurethane;

said first portion making up between 10 wt. % and 60 wt. % of said functional zone; and the polyurethane material of said nonwoven fibers of said first portion having a hardness between 35 Shore D and 85 Shore D.

2. The clothing according to claim 1, wherein said nonwoven fibers of said first portion consist of a thermoplastic polyurethane.

3. The clothing according to claim 1, wherein said first portion makes up between 20 wt. % and 45 wt. % of said functional zone.

4. The clothing according to claim 1, wherein said polyurethane material of said nonwoven fibers of said first portion has a hardness between 50 Shore D and 85 Shore D.

5. The clothing according to claim 1, wherein said functional zone extends in the thickness direction for less than 5 mm.

6. The clothing according to claim 1, wherein said nonwoven fibers of said first portion have a fiber fineness between 30 dtex and 80 dtex.

7. The clothing according to claim 6, wherein said nonwoven fibers of said first portion have a fiber fineness between 50 dtex and 70 dtex and said nonwoven fibers of said second portion have a fiber fineness between 20 dtex and 70 dtex.

8. The clothing according to claim 1, wherein said nonwoven fibers of said second portion have a fiber fineness between 10 dtex and 80 dtex.

9. The clothing according to claim 1, wherein said first portion and/or said second portion comprise nonwoven fibers with different fiber fineness.

10. The clothing according to claim 1, wherein between 15 $g/m^2$ and 250 $g/m^2$ of nonwoven fibers of said first portion are provided in said nonwoven support.

11. The clothing according to claim 1, wherein between 100 $g/m^2$ and 1500 $g/m^2$ of nonwoven fibers of said second portion are provided in said nonwoven support.

12. The clothing according to claim 1, which comprises at least one further functional zone in which said first portion amounts to less than 10 wt. %, and which is disposed between said basic structure and said functional zone and/or between said functional zone and a surface of the clothing.

13. The clothing according to claim 1, wherein said functional zone forms a surface of the clothing.

14. The clothing according to claim 1, wherein said nonwoven support is provided on a side of said basic structure disposed for touching the fibrous web.

15. The clothing according to claim 1, wherein said basic structure consists of a flat weave.

16. The clothing according to claim 1, wherein said basic structure is a flat weave with end-side edges and having a length substantially twice a length of the clothing in a finished condition, said flat weave being folded at folds and defining folded portions that are deposited back onto the flat weave to form a two-layer structure, and wherein seam loops are formed at said folds, enabling the basic structure to be merged with a pintle to form an endless structure.

17. The clothing according to claim 1, wherein said basic structure comprises a flat weave that is narrower than said basic structure in a width direction and said basic structure is formed by spiraling said flat weave.

18. The clothing according to claim 1, wherein said nonwoven fibers of said first portion consist of polyurethane.

19. A method for producing a clothing for a machine for producing a fibrous web, the method comprising:

i) providing a basic structure;

ii) providing a functional nonwoven layer, the functional nonwoven layer to extend over more than 50 μm in a thickness direction of the clothing and including a first portion and a second portion of nonwoven fibers, the nonwoven fibers of the first portion containing a polyurethane, the nonwoven fibers of the second portion consisting of a polymer material not including a polyurethane, and the first portion making up between 10 wt. % and 60 wt. % of the functional nonwoven layer; and the polyurethane material of the nonwoven fibers of the first portion having a hardness between 35 Shore D and 85 Shore D; and iii) securing the functional nonwoven layer, and optionally securing further nonwoven layers, to the basic structure by needling.

* * * * *